US005987670A

United States Patent [19]

Sims et al.

[11] Patent Number: 5,987,670

[45] Date of Patent: Nov. 23, 1999

[54] MEDICAL EQUIPMENT TRANSPORT SYSTEM

[75] Inventors: Nathaniel M. Sims, Wellesley Hills, Mass.; Michael H. Wollowitz, Chatham, N.Y.

[73] Assignee: The General Hospital Corporation, Boston, Mass.

[21] Appl. No.: 09/065,659

[22] Filed: Apr. 23, 1998

[51] Int. Cl.[6] ..... A47B 71/00

[52] U.S. Cl. ..... 5/600; 5/658; 5/503.1

[58] Field of Search ..... 248/220.22, 230.1, 248/230.8, 74.3; 5/503.1, 507.1, 658, 659, 600

[56] References Cited

U.S. PATENT DOCUMENTS

| | | | |
|---|---|---|---|
| 3,709,372 | 1/1973 | Alexander | 5/503.1 X |
| 4,511,157 | 4/1985 | Wilt, Jr. | 280/289 |
| 4,511,158 | 4/1985 | Varga et al. | 280/292 |
| 4,591,121 | 5/1986 | Doyle | 248/201 |
| 4,591,122 | 5/1986 | Kreuzer | 248/280.1 |
| 4,600,209 | 7/1986 | Kerr, Jr. | 280/400 |
| 4,729,576 | 3/1988 | Roach | 280/493 |
| 4,886,237 | 12/1989 | Dennis | 248/289 |
| 4,945,592 | 8/1990 | Sims et al. | 5/508 |
| 5,009,442 | 4/1991 | Schneider | 280/304.1 |
| 5,117,521 | 6/1992 | Foster et al. | 5/510 |
| 5,118,127 | 6/1992 | Partington | 280/488 |
| 5,149,036 | 9/1992 | Sheenan | 248/215 |
| 5,219,139 | 6/1993 | Hertzler | 248/276 |
| 5,236,213 | 8/1993 | Trickett | 280/304.1 |
| 5,288,093 | 2/1994 | Gross | 280/292 |
| 5,319,816 | 6/1994 | Ruehl | 5/600 |
| 5,335,651 | 8/1994 | Foster et al. | 128/202.13 |
| 5,344,169 | 9/1994 | Pryor et al. | 280/79.3 |
| 5,355,539 | 10/1994 | Boettger | 5/503.1 |
| 5,370,111 | 12/1994 | Reeder et al. | 128/202.13 |
| 5,374,074 | 12/1994 | Smith | 280/304.1 |
| 5,385,324 | 1/1995 | Pryor et al. | 248/231.7 |
| 5,400,995 | 3/1995 | Boyd | 248/414 |
| 5,421,548 | 6/1995 | Bennett et al. | 248/129 |
| 5,509,680 | 4/1996 | Scharf et al. | 280/304.1 |
| 5,527,125 | 6/1996 | Kreuzer et al. | 403/325 |
| 5,529,427 | 6/1996 | Bost | 403/391 |
| 5,556,065 | 9/1996 | Wadley | 248/129 |
| 5,588,166 | 12/1996 | Burnett | 5/503.1 |
| 5,647,491 | 7/1997 | Foster et al. | 211/113 |
| 5,699,988 | 12/1997 | Boettger et al. | 248/122.1 |
| 5,829,178 | 11/1998 | Hillstrom | 40/612 X |

*Primary Examiner*—Terry Lee Melius
*Assistant Examiner*—James M. Hewitt
*Attorney, Agent, or Firm*—Nutter, McClennen & Fish, LLP

[57] ABSTRACT

A system for securing a wheeled pole, such as an IV pole, to an adjustable height mobile bed to form a movable assembly. The system includes a linkage element with first and second mounting blocks effective to secure the linkage element to an intermediate frame portion of the bed. An elastomeric member is extendable from the linkage element for engagement with a plurality of engagement members disposed on opposite sides of a channel formed in the linkage element. The elastomeric member effectively secures the IV pole in the channel for transport of the IV pole/bed assembly.

14 Claims, 11 Drawing Sheets

FIG. 14
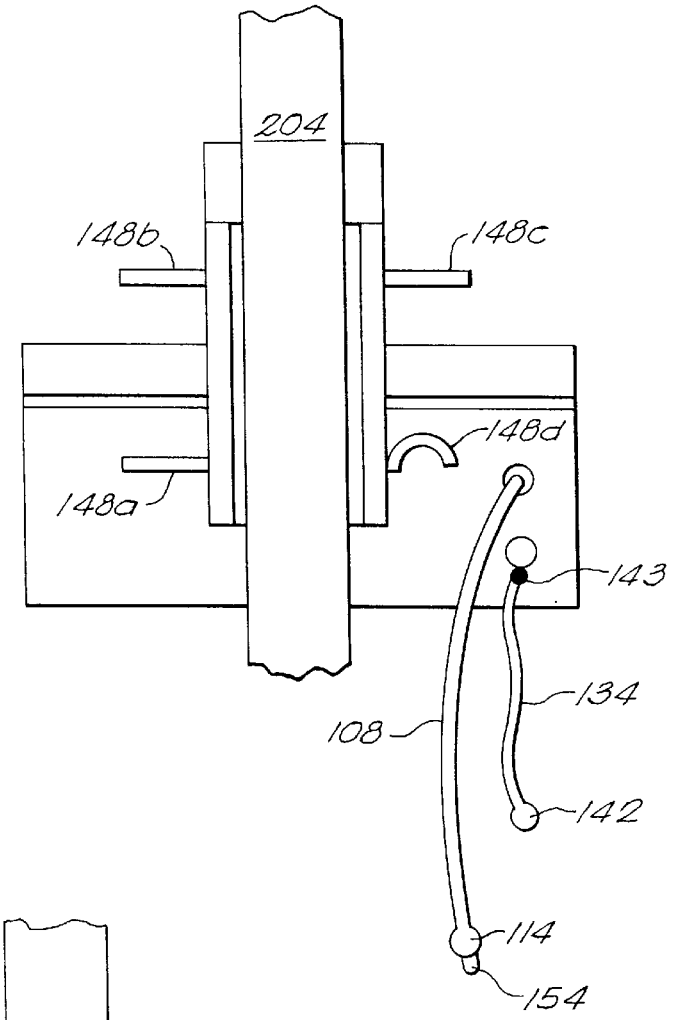
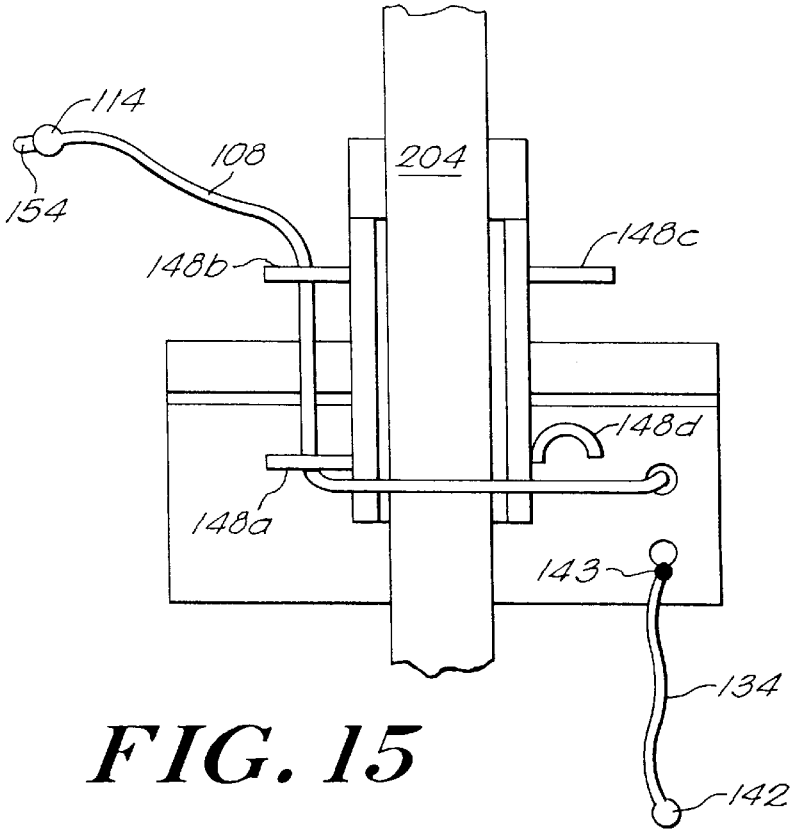
FIG. 15

MEDICAL EQUIPMENT TRANSPORT SYSTEM

CROSS REFERENCE TO RELATED APPLICATION

Not applicable.

STATEMENT REGARDING FEDERALLY SPONSORED RESEARCH

Not applicable.

FIELD OF THE INVENTION

The present invention relates to equipment transport systems and more particularly to a system for securing one piece of movable equipment to at least one other piece of movable equipment to form a movable assembly.

BACKGROUND OF THE INVENTION

There are many instances where it is desirable to attach one or more pieces of equipment together to form a movable assembly. For example, hospital patients are generally placed in a wheeled hospital bed so that the patients can be moved from one location to another, such as to and from various hospital wards. These patients often have one or more pieces of medical equipment located near the bed for providing various treatments. One such piece of equipment is an intravenous drip bag mounted on a pole extending from a wheeled base or cart (IV pole). When transporting a patient it is usually preferable to keep the IV pole with the patient so as to maintain the flow of solution from the drip bag to the patient. However, transporting a patient coupled to an IV can require additional medical personnel to ensure that the IV pole safely accompanies the patient.

In order to eliminate the need for the additional personnel, various attempts have been made to secure the IV pole to the bed when transporting a patient coupled to an IV. While this may not initially appear to be problematic, a system for coupling the bed and IV pole that is compact, quick, reliable and flexible has proven to be elusive due to competing design requirements and safety issues.

Various obstacles associated with coupling a hospital bed and IV pole are revealed upon examining these components. As shown in FIG. 1, a typical hospital bed 10 has a lower frame 12 supported on a set of wheels 14, an intermediate frame 16 that moves vertically in relation to the lower frame, and an upper frame 20 coupled to the intermediate frame 16 for raising the upper torso of a patient resting on a mattress 22. Generally, the bed 10 further includes a detachable headboard 24 and footboard 26.

FIGS. 2–5 show the bed 10 in various positions including lowered (FIG. 2), raised (FIG. 3), declined, i.e., Trendelenberg (FIG. 4) and inclined, i.e., reverse Trendelenberg (FIG. 5). As shown, the height H of the intermediate frame 16 from the floor 28 can vary depending upon the position desired for or by the patient.

FIG. 6 shows a typical IV pole 50 having a relatively heavy base 52 with wheels 55 affixed to the base from which a column 54 vertically extends. A rack 56 is attached to the column 54 for holding drip bags and other equipment, such as infusion pumps and patient monitoring equipment.

A system for securing the pole 50 to the bed 10 should provide safe, rapid, reliable and secure attachment while accommodating the adjustable features of the bed 10. The secured IV pole should not present hazards to patients or to staff during use. One potential danger to be prevented is the IV pole tipping over. An IV pole and rack may be supporting significant weight that could cause serious injury upon impact or during an attempt to catch a falling pole. A further consideration is the location of the IV pole in relation to the bed. While the pole may initially appear to be well removed from a patient, upon adjustment of the bed, such as to maximum height and/or tilt, the head of a patient may strike a component of the IV pole thereby causing injury. The system should also maintain a predetermined distance between the IV pole and the bed to prevent the pole from striking the bed during transport, or pinching an appendage of a staff person or the IV tubing.

Various attempts have been made to provide a system for coupling an IV pole to a bed that meets the above criteria. Some coupling systems secure the pole to the intermediate portion 16 of the bed frame. Although the intermediate portion 16 of the frame is accessible and can provide adequate stability for the pole, the adjustable height and tilt of the intermediate portion 16 make this portion of the bed unable to provide a fixed attachment point. Further, unstable coupling of the IV pole 50 to the intermediate portion 16 of the frame can cause a top heavy IV pole 50 to tip over in the event that the height of the bed is adjusted. While the lower portion 12 of the frame provides a fixed attachment point, the lower frame is close to the floor and not readily accessible. See also, U.S. Pat. Nos. 5,344,169 (Pryor et al.), 5,118,127 (Partington), and 4,149,036 (Sheehan).

One system to link an IV pole and a hospital bed, known as "MobilEquip" made by Hill-Rom of Batesville, Ind., includes a cart having at least one pole extending from the cart. The cart is secured to the lower portion of the bed frame via a linking arm. This arrangement may adequately support the IV pole but dramatically increases the size of the bed/cart assembly as compared with the bed alone. The overall dimensions of the assembly can be a significant impediment when maneuvering the bed through hallways and elevators. Other linking systems are disclosed in U.S. Pat. Nos. 5,647,491 (Foster et al.), 5,400,995 (Boyd), and 5,319,816 (Ruehe).

Another system, known as "Omni-Pal" made by Pryor Products of Oceanside, Calif., provides a plurality of IV poles mounted to a frame that is secured to a modified intermediate frame portion of the bed. A wheel assembly is swung outward from the base when transporting a patient for stabilizing the assembly. In addition to the space required for the frame and wheel assembly, there is no provision to accommodate height adjustments of the bed. See also, U.S. Pat. No. 5,344,169 to Pryor et al.

A still further system, the "Pump Porter" made by Majoska, Inc. of Indianapolis, Ind., includes a roller chain with clamping elements at either end. One clamp is secured to the pole and the other to the bed. The chain flexes in a sideways motion but resists bending and twisting motion that could allow the IV pole to tip over. However, this device cannot accommodate bed height adjustments and is incompatible with certain types of commonly used hospital beds. See also, U.S. Pat. No. 5,118,127 to Partington.

It would be desirable to provide a system for attaching an IV pole to an adjustable bed that can accommodate a variety of beds and poles and is safe, secure, quick, reliable and compact.

SUMMARY OF THE INVENTION

The present invention provides a system for quickly and securely attaching one piece of movable equipment (e.g., a mobile hospital bed) to at least one other piece of movable equipment (e.g., a transportable IV pole) to form a movable assembly. Although the invention is primarily shown and described in conjunction with securing an intravenous (V) pole to a hospital bed, it is understood that the invention has other applications as well.

In one embodiment, a system for linking a hospital bed and an IV pole includes a linkage element having first and second mounting blocks that are effective to secure the linkage element to an intermediate frame portion of the bed. An attachment mechanism is positioned proximate the linkage element and includes first and second engagement members disposed on opposite sides of a channel formed in the linkage element. An elongate elastomeric member is extendable from the linkage element for coupling with the engagement members such that the IV pole is captured in the channel formed in the linkage element.

To secure the IV pole to the bed, the first and second mounting blocks of the linkage element are positioned and secured to opposing surfaces of the bed frame. The IV pole is placed within the channel and the elastomeric member is extended from the linkage element. The elastomeric member is routed across the IV pole at least once and coupled with the first and second engagement members such that the elastomeric member effectively captures the IV pole in the channel.

BRIEF DESCRIPTION OF THE DRAWINGS

The invention will be more fully understood from the following detailed description in conjunction with the accompanying drawings, in which:

FIG. 14 is a front view of the system of FIG. 13 shown in a second position;

FIG. 15 is a front view of the system of FIG. 13 shown in a third position;

DETAILED DESCRIPTION OF THE INVENTION

Figure 6:
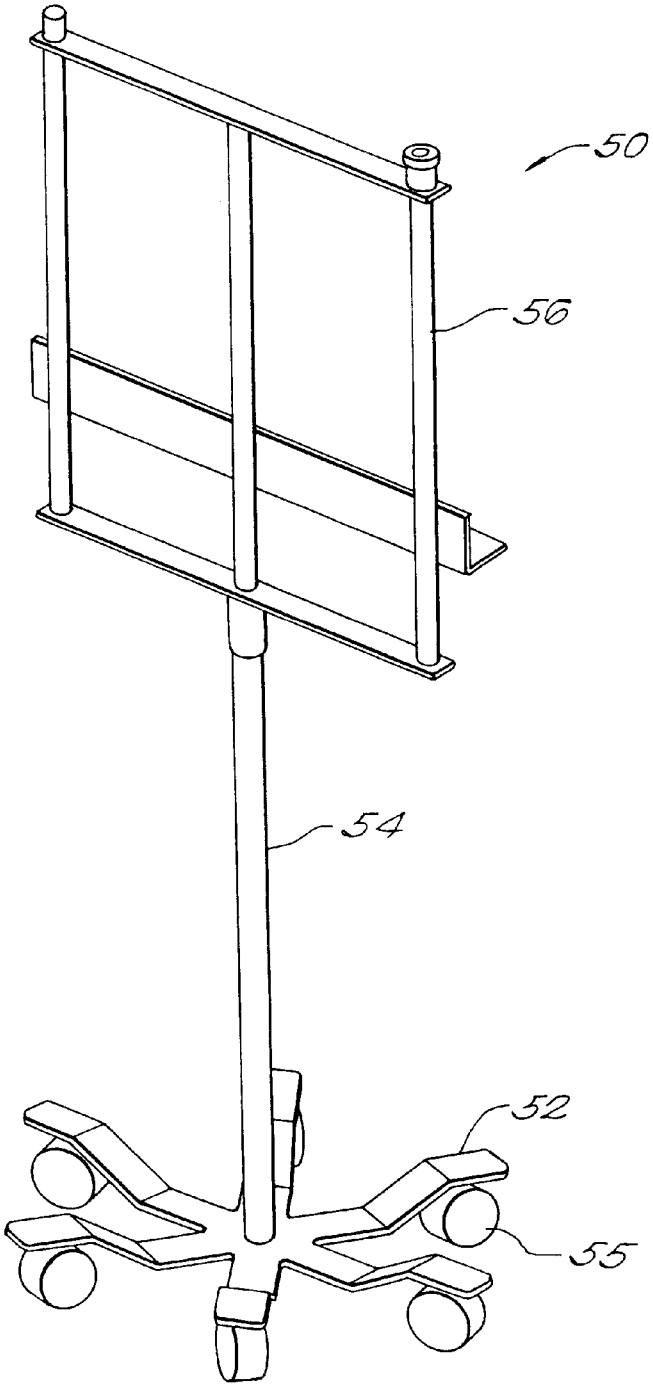
FIG. 6 (PRIOR ART)
FIG. 6 is a perspective view of a prior art intravenous pole.
Figure 7:
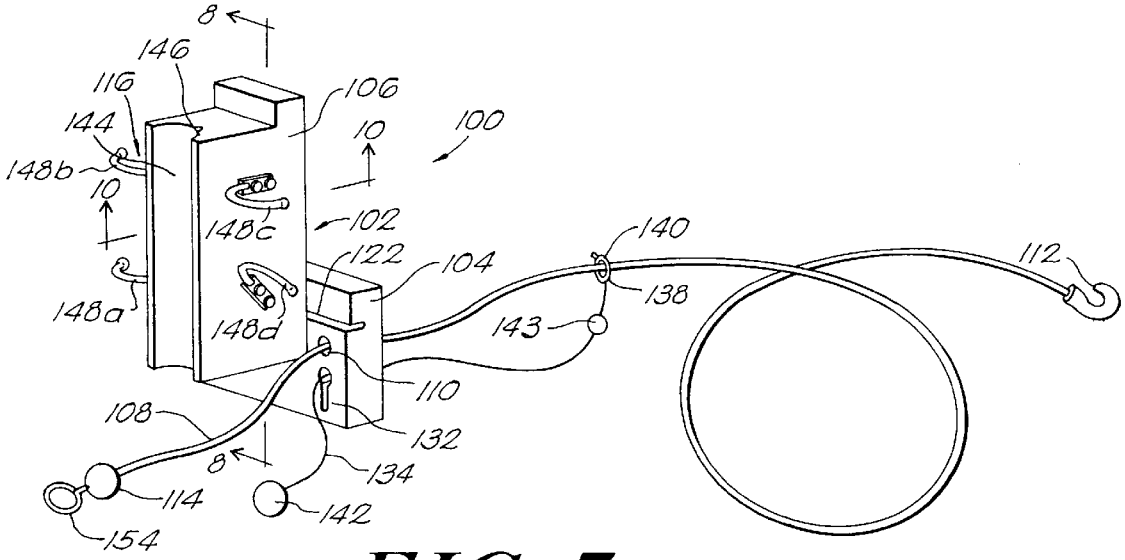
FIG. 7 is a perspective view of an equipment attachment system in accordance with the present invention.
Figure 8:
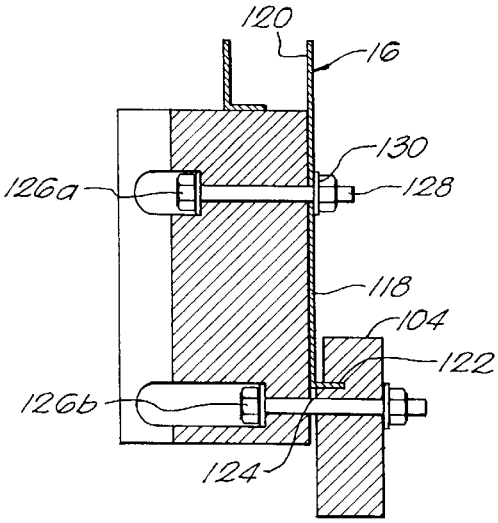
FIG. 8 is a cross sectional view of the system of FIG. 7 along lines 8—8 shown secured to a hospital bed.

FIGS. 7–8 show an exemplary embodiment of a system 100 for securing a first piece of equipment 10, such as hospital bed (FIG. 1), to a second piece of equipment 50, such as an intravenous (V) pole (FIG. 6). The system 100 includes a linkage element 102 having a first mounting block 104 that is matable to the bed and a second mounting block 106 for linking and aligning an IV pole with the system. The first mounting block 104 of the linkage element facilitates a secure connection between the second mounting block 106 and a conventional hospital bed. It is understood, however, that in other embodiments the second block 106 can be secured to the bed without the first mounting block 104. For example, a bed can have a structure to which the second mounting block 106 is securely matable without the need of another component, e.g., the first mounting block 104.

The system 100 further includes an elongate elastomeric member 108, i.e., an elastic cord, slidably coupled with the linkage element 102. The elastic cord 108 has a first end 112 that is securable on or adjacent to the hospital bed 10 and a second end 114 that is matable with an attachment mechanism 116 (e.g., hooks) that extends from the linkage element 102. The elastic cord 108 captures and secures the IV pole to the linkage element 102, as described below. In general, however, the ends of the cord 108 remain attached to the linkage element 102 and/or the hospital bed while an intermediate portion of the cord 102 surrounds and captures the IV pole 50.

Figure 1:
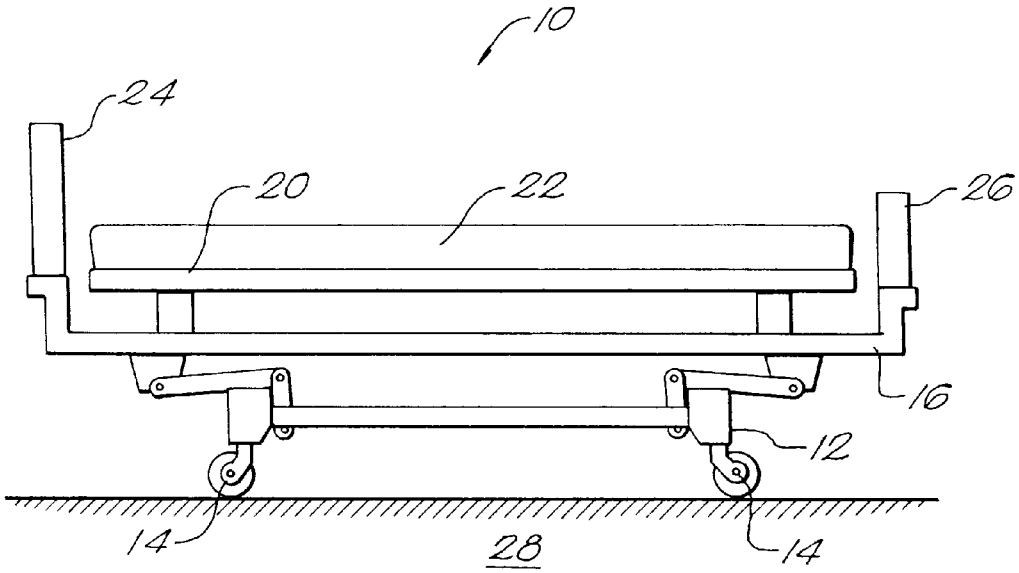
FIG. 1 (PRIOR ART)
FIG. 1 is a side view of a prior art hospital bed.
Figure 2:
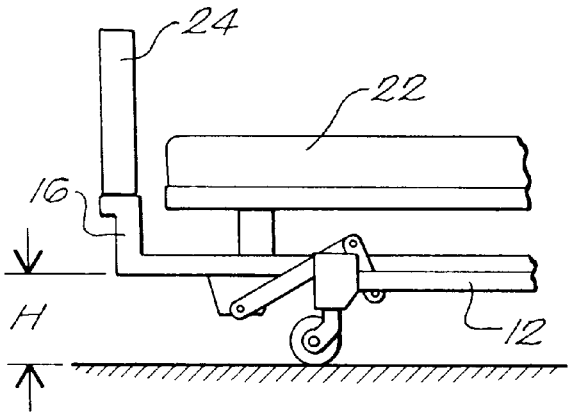
FIG. 2 (PRIOR ART)
FIG. 2 is a partially cut-away side view of the prior art hospital bed of FIG. 1 shown in a lowered position.
Figure 3:
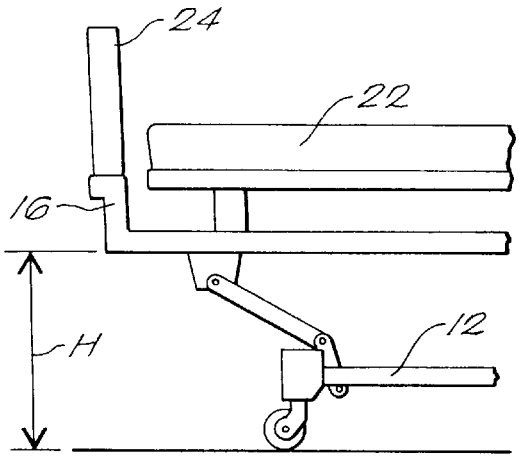
FIG. 3 (PRIOR ART)
FIG. 3 is a partially cut-away side view of the prior art hospital bed of FIG. 1 shown in a raised position.
Figure 4:
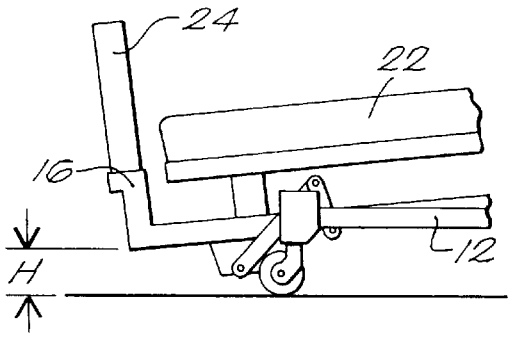
FIG. 4 (PRIOR ART)
FIG. 4 is a partially cut-away side view of the prior art hospital bed of FIG. 1 shown in a declined position.
Figure 5:
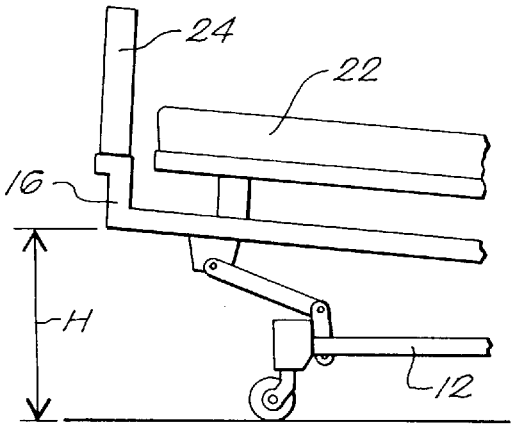
FIG. 5 (PRIOR ART)
FIG. 5 is a partially cut-away side view of the prior art hospital bed of FIG. 1 shown in an inclined position.

FIG. 8 shows an illustrative technique for mounting the linkage element 102 to the intermediate frame portion 16 of a typical hospital bed 10 (FIG. 1). The linkage element 102 can be secured to either end of the intermediate portion 16 of the frame, preferably at the head end of the bed. The first mounting block 104 of the linkage element is positioned adjacent an inside surface 118 of the frame 16 and the second mounting block 106, or alignment block, of the linkage element is placed adjacent an outside surface 120 of the frame. The first mounting block 104 of the linkage element can include a groove 122 that is able to receive a flanged portion 124 of the frame. The first and second blocks 104,106 of the linkage element 102 can be affixed to the frame 16 using fastening systems such as nuts and bolts, adhesives, welds, rivets, and clamps. In the exemplary embodiment shown, the linkage element 102 is secured to the bed with upper and lower mounting assemblies 126a, 126b, each including a bolt 128 and corresponding nut 130.

The elastic cord 108 can be coupled with the linkage element 102 in a variety of configurations. For example, the linkage element 102 can include loops, biased spool members, and/or bores. In the illustrated embodiment shown in FIG. 7, cord 108 passes through a bore 110 formed in the alignment block 104 of the linkage element. The cord 108 freely slides within the bore 110. However, the second end 114 of the cord is enlarged to prevent this end of the cord from passing through the bore 110. In one embodiment, the second end 114 includes a ball or a knot that has a diameter larger than that of the bore.

Figure 9:
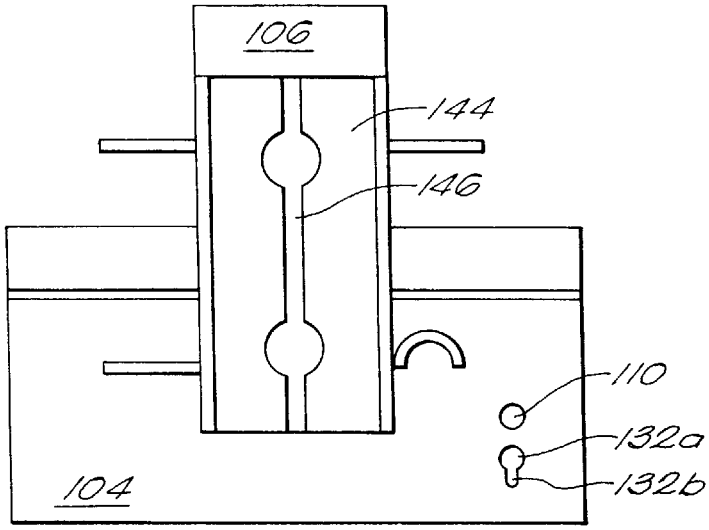
FIG. 9 is a front view of the system of FIG. 7.

To manipulate the elastic cord 108, an aperture 132 can be formed in the linkage element 102 for capturing an optional inelastic cord 134 coupled to the elastic cord 108. In one embodiment, the aperture 132 has a larger first section 132*a* (FIG. 9) and a smaller second section 132*b*, thus providing a keyhole-shaped opening. The inelastic cord 134 has a first end 138 coupled to the elastic cord 108 at a predetermined location forming an enlargement or knot 140 and an enlarged second end 142 that is unable to pass through the aperture 132. The inelastic cord 134 includes a ball member 143 secured to the inelastic cord at a location generally near the knot 140. The ball member 143 has a geometry such that it will pass through the larger section 132*a* but not the smaller section 132*b*. Alternatively, the knot 140 is sized such that it will pass through the larger section 132*a* of the aperture but not the smaller section 132*b*.

The inelastic cord 134 is effective to relieve tension from the second end 114 of the elastic cord 108 so as to facilitate connection of this end of the elastic cord to the attachment mechanism 116. The inelastic cord 134 can be pulled in a direction away from the linkage element 102 until the ball member 143 passes through the larger section 132*a* of the aperture, at which point the inelastic cord 108 is manipulated to cause the ball member 143 to be located in front of the smaller section 132*b*. The ball member 143 is thereby is prevented from passing back through the aperture 132. As described in further detail below, this technique helps relieve tension from the second end 114 of the elastic cord 108 for easy engagement with the attachment mechanism 116.

The attachment mechanism 116 can be formed in a variety of configurations that provide secure and rapid attachment of an IV pole to the linkage element 102. The attachment mechanism 116 should be engagable with the elastic cord 108 to enable capture of the pole within the block 102. Exemplary attachment mechanisms include structures such as hooks, protrusions, loops, clasps and clamps.

Figure 12:
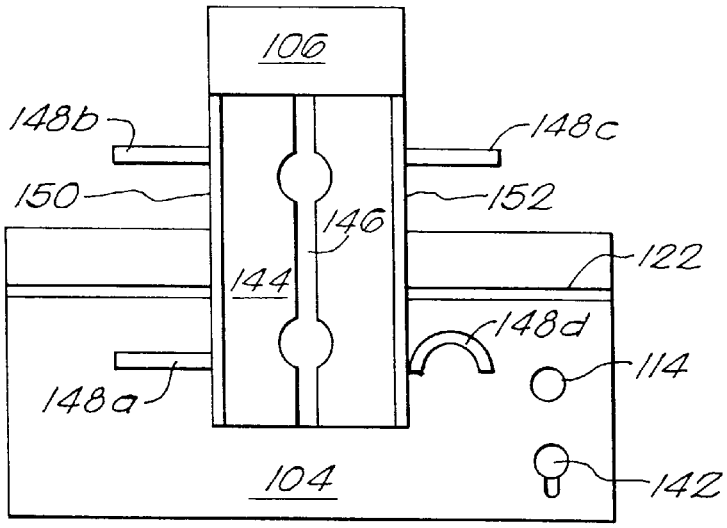
FIG. 12 is a further front view of the system of FIG. 7.

FIGS. 7 and 12 show an exemplary attachment mechanism 116 embodiment. The attachment mechanism 116 is formed from a plurality of hooks 148 disposed on either side of a channel 144 of the alignment block 106. More particularly, first and second hooks 148*a*, 148*b* are disposed on a first side 150 of the alignment block 106 and third and fourth hooks 148*c*, 148*d* are disposed on a second side 152 of the alignment block 106. The fourth hook 148*d* can be misaligned with respect to the other hooks to facilitate and retain engagement with the second end 114 of the cord, as described below.

It is understood that one of ordinary skill in the art can readily modify the illustrated attachment mechanism 116. For example, a greater or lesser number of hooks can be used and placed in varying positions. The hooks can be integral with the block or they can be affixed to the bed frame.

Figure 10B:
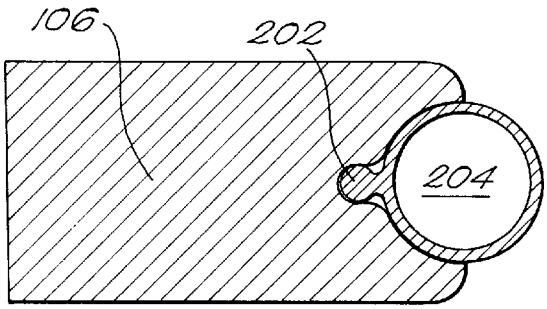
Figure 10B is a further cross-sectional view of the system of FIG. 10A.
Figure 10A:
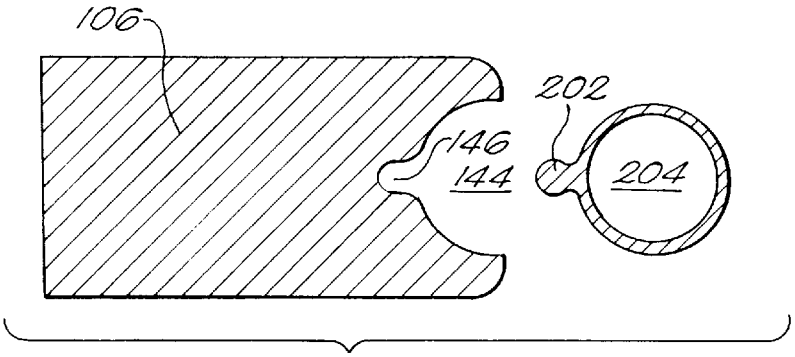
FIG. 10A is a cross-sectional view of the system of FIG. 7 along lines 10—10 shown in conjunction with an IV pole.
Figure 11:
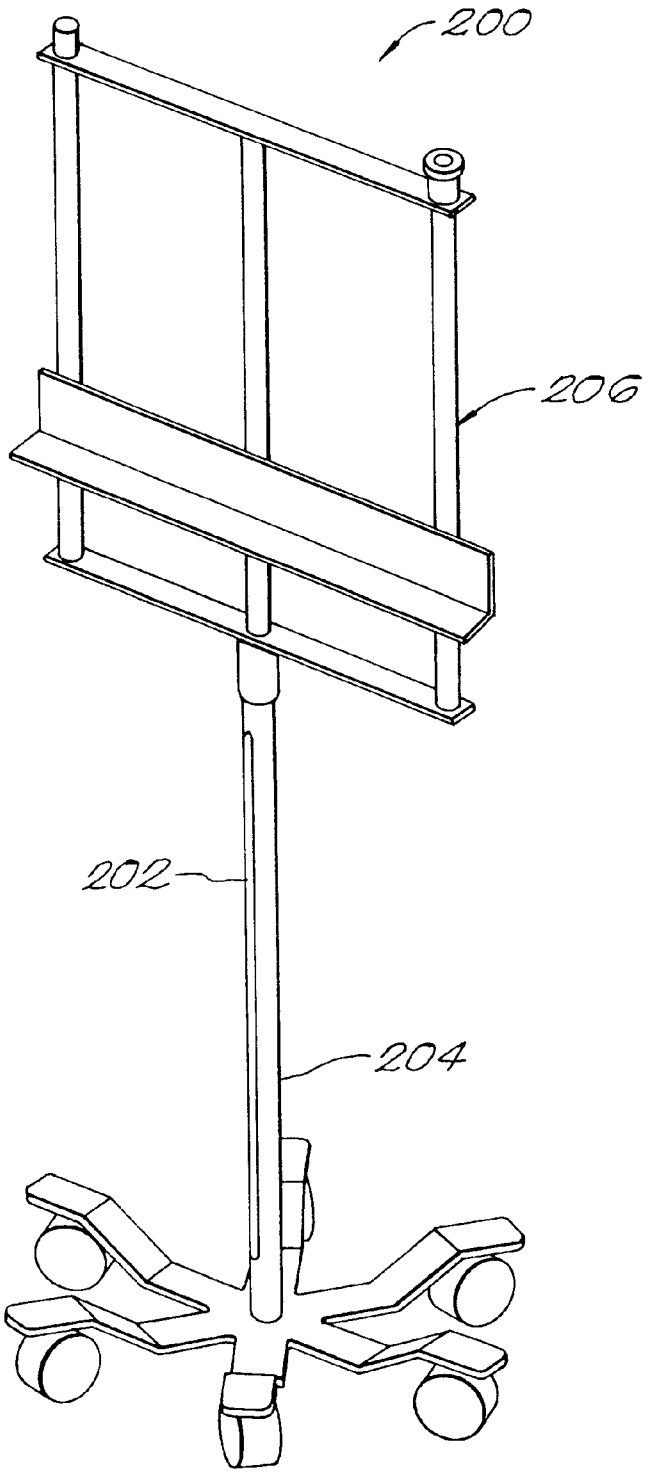
FIG. 11 is a perspective view of an IV pole adapted for use with the system of FIG. 7.

As shown in FIGS. 10A–B, the system can include a mechanism to prevent rotation of an IV pole secured to a bed. In the exemplary embodiment shown in FIGS. 10A–B, the alignment block 106 of the linkage element 102 includes a longitudinal channel 144 formed therein for receiving a portion of an IV pole 200 (FIG. 11). The channel 144 further includes a groove 146 into which a bead 202 formed on the column or pole 204 of the IV pole can be inserted. When the pole 204 and attached rack 206 are placed in the channel, the bead 202 is captured by the groove 146 to prevent rotation of the pole with respect to the bed.

Figure 13:
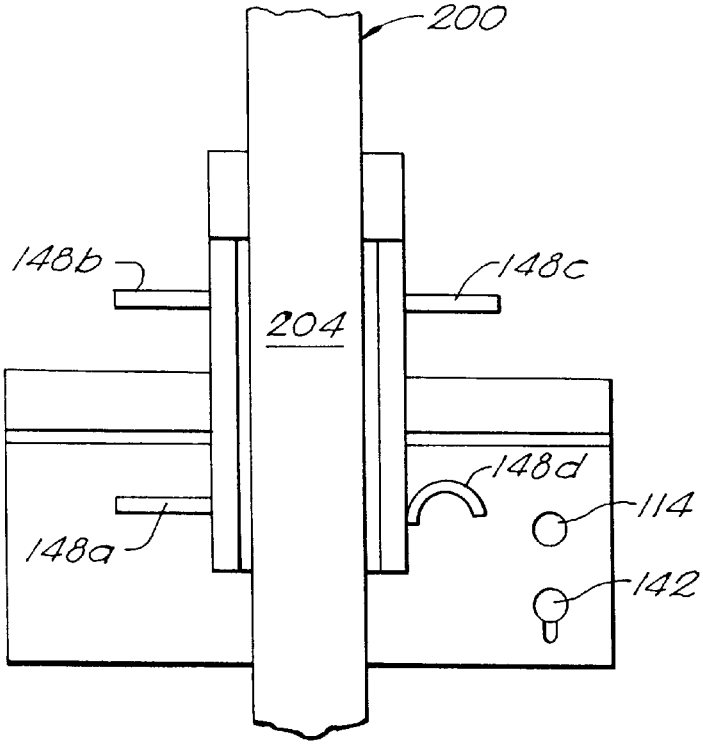
FIG. 13 is a front view of the system of FIG. 7 shown in conjunction with an intravenous pole and in a first position.

FIGS. 13–17 show an exemplary sequence of steps for securing the pole 200 to the bed 10. As shown in FIG. 13, initially the second ends 114,142 of the elastic and inelastic cords 108,134 (FIGS. 14–16) are positioned adjacent the linkage element 102. The first end 112 of the elastic cord 108 is secured to the bed frame 16 (FIG. 8) such that tension is present in the cord thereby biasing the second end 114 to the linkage element 102. The second end 142 of the inelastic cord 134 is pulled into proximity with the linkage element 102 due to the attachment of the inelastic cord to the elastic member 108 at the knot 140.

The column 204 of the IV pole is then placed within the channel 144 such that the longitudinal bead 202 is received in the groove 146. The inelastic cord 134 is pulled away from the block 102 until the ball member 143 passes through the larger section 132*a* of the aperture. The ball member 143 is then slid in a direction toward the smaller section 132*b* of the aperture such that the ball member 143 is prevented from passing back through the aperture due to the relative dimensions of the ball member 143 and the smaller section 132*b* (FIG. 14).

Figure 16:
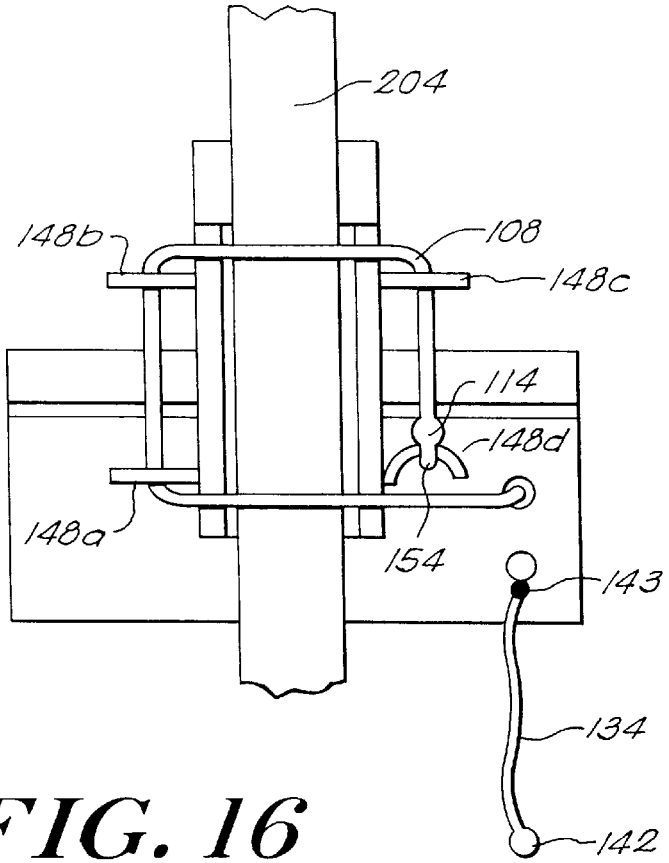
FIG. 16 is a front view of the system of FIG. 13 shown in a fourth position.
Figure 17:
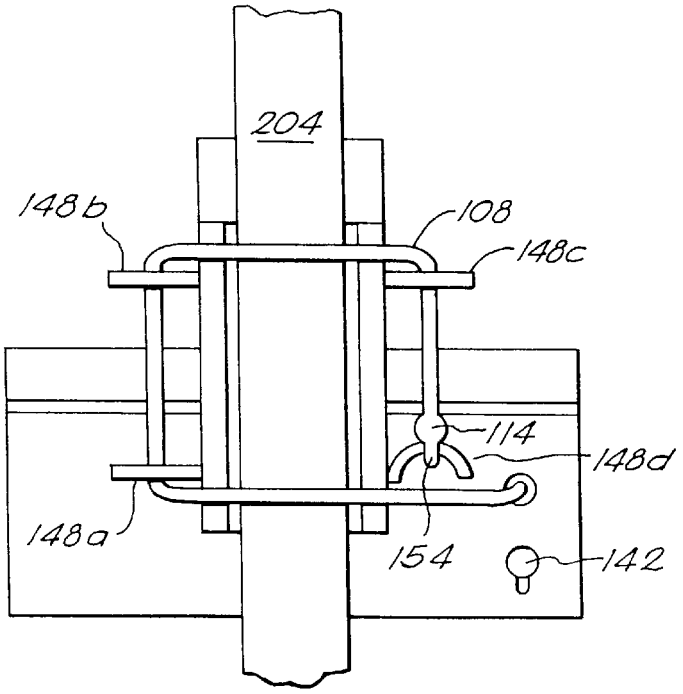
FIG. 17 is a front view of the system of FIG. 13 shown in a fifth position.
Figure 18:
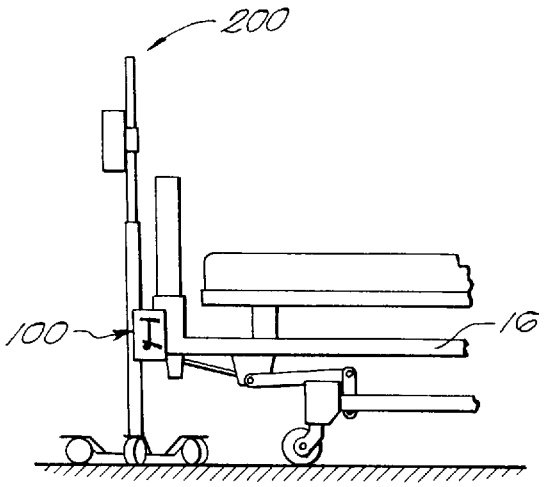
FIG. 18 is a partially cut-away side view of the system of the invention shown in further conjunction with a hospital bed.
Figure 19:
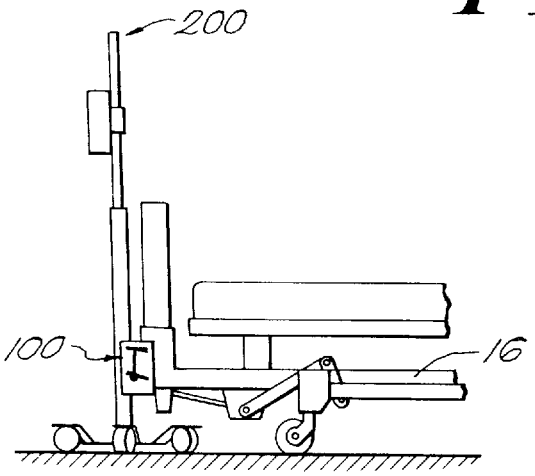
FIG. 19 is a partially cut-away side view of the system of FIG. 18 showing the bed in a lowered position.
Figure 20:
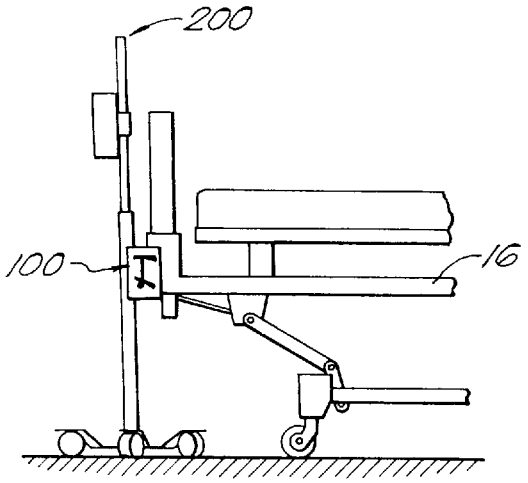
FIG. 20 is a partially cut-away side view of the system of FIG. 18 showing the bed in a raised position.
Figure 21:
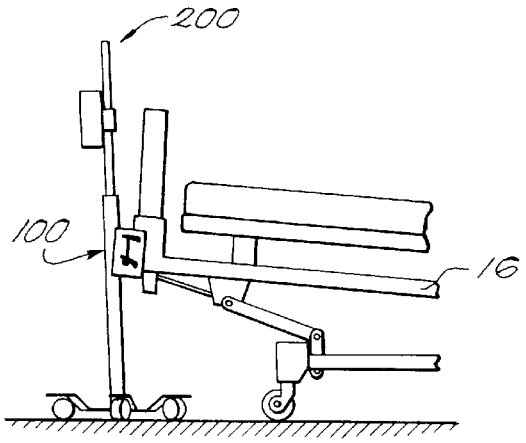
FIG. 21 is a partially cut-away side view of the system of FIG. 18 showing the bed in an inclined position.
Figure 22:
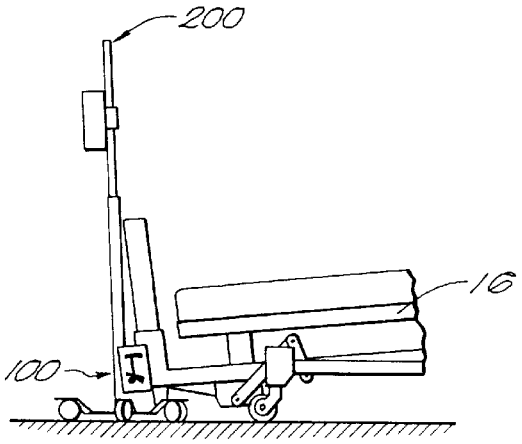
FIG. 22 is a partially cut-away side view of the system of FIG. 18 showing the bed in a declined position.

Since the ball member 143 prevents retraction of the cord 134 through the aperture 132, tension is removed from a portion of the elastic cord 108 extending generally from the knot 140 to the second end 114 of the cord 108. The second end 114 of the cord is then freely engagable with the hooks 148. More particularly, the cord 108 is routed across the IV pole 204 located in the channel 144 and maneuvered under the first and second hooks 148*a*, 148*b* (FIG. 15). The cord 108 is then routed back across the pole 204 and under the third hook 148*c* so that the second end 114 of the cord can be engaged with the angled fourth hook 148*d* (FIG. 16). In an exemplary embodiment, a loop 154 is coupled to the second end 114 of the cord for attachment to the fourth hook 148*d*.

After securing the second end 114 of the elastic cord 108 to the fourth hook 148*d*, the ball member 143 is moved to allow passage through the larger section 132*a* of the aperture. Tension thereby returns to the elastic cord 108 to securely capture the IV pole 204 within the channel 144 (FIG. 17) by the action of an intermediate portion of elastic cord 108.

By sequencing through the exemplary steps set forth above, one can rapidly secure an IV pole to the bed to facilitate transport of a patient coupled to an IV. That is, one can move the pole 204 into the channel 144, pull out the inelastic cord 134 to remove tension from the elastic cord 108, engage the elastic cord 108 with the hooks 148, and manipulate the inelastic cord 134 to reapply tension to the elastic cord. Similarly, the IV pole can be disengaged from the bed by reversing the sequence of steps.

FIGS. 18–22 show the IV pole secured to the bed 10 at various bed heights and tilts. The elastic cord 108 stretches to accommodate an inclined or declined bed without causing the IV pole 200 to be displaced from a generally vertical position. In the event that the intermediate portion 16 of the bed frame is raised or lowered, the block 102 and cord 108 freely slide along the pole. More particularly, the bead 202 on the IV pole 200 moves longitudinally in the groove 146 in response to vertical movement of the bed frame while still preventing rotation of the pole with respect to the block 202.

The elastic cord 108 easily slides along the pole to adjust to the new bed height. Thus, the IV pole 200 is not susceptible to tipping over and does not present a danger to the patient during adjustments of the bed.

The overall dimensions of the various components can vary. The elastic cord 108 should be sized to support the IV pole, yet not prevent vertical movement along the IV pole during bed height adjustments. The length of the elastic cord 108 can vary in length from about 4.0 feet to about 6.0 feet, and the length of the inelastic cord 134 can vary in length from about 2.0 feet to about 3.5 feet. In one embodiment, the elastic cord 108 is about 5.0 feet in length and the inelastic cord 134 is about 3.0 feet in length.

The dimensions of the mounting and alignment blocks 104,106 of the block are selected to provide secure attachment to the bed frame and position the IV pole at a desired distance from the bed. In an exemplary embodiment, the mounting block 104 of the linkage element has a length of about 4.50 inches, a width of about 3.00 inches, and a depth of about 1.25 inches. The alignment block 106 has a length of about 6.75 inches, a width of about 2.00 inches, and a depth of about 3.50 inches. These dimensions for the components of the linkage element position the IV pole at a distance from about 0.500 inch to about 3.00 inches from the intermediate portion of the bed frame. A preferred distance from the bed frame is about 1.00 inch.

Figure 23:
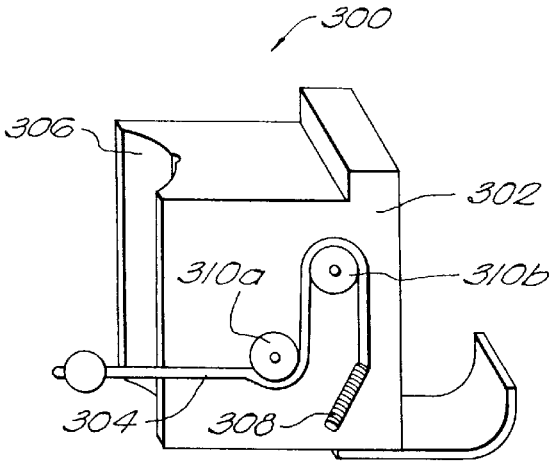
FIG. 23 is a perspective view of a further embodiment of a system for securing an IV pole to a hospital bed in accordance with the present invention.

FIG. 23 shows a farther embodiment of a system 300 for securing an IV pole 200 (FIG. 11) to an adjustable bed 10 (FIG. 1). The system 300 includes a housing 302 that can be secured to the intermediate portion 16 of a bed frame, as described above. An inelastic cord 304 is extendable from the housing 302 to secure an IV pole 204 disposed within a channel 306 formed in the housing. The cord 304 is coupled to a biasing member 308 for providing tension to the cord for securely attaching the pole 204 to the housing 302. Optional pulley wheels 310*a,b* are effective to reduce the force required to extend the spring 308. The wheels 310 can be selectably rotatable to prevent extension or retraction of the cord 304 from or into the housing 302.

In another embodiment (not shown), a system provides selectable unidirectional and bidirectional movement of a cord from a housing. As the cord is pulled from the housing in the unidirectional mode, there is no tension on the cord. The cord is then easily engaged with a hook or other device. After engagement, tension is reapplied to the cord upon selecting the bidirectional mode.

The various components of the invention can be formed from materials suitable for the particular component. It is understood that elastomeric member, as used herein, is to be construed broadly to include any elongate member that is elastically deformable so as to possess tension. It is further understood that the elastomeric member can include elastic and inelastic portions. For example, the elastomeric member can have an inelastic portion coupled to a biasing member, such as a spring. Exemplary materials for the elastomeric member include multifilament cords, such as cords having a latex rubber core and a woven cover, and monofilament cords formed from an extruded elastomer. The block can be formed from generally rigid materials including metals and plastics known to one of ordinary skill in the art.

One skilled in the art will realize further features and advantages of the invention from the above-described embodiments. Accordingly, the invention is not to be limited by what has been particularly shown and described, except as indicated by the appended claims. All publications and references cited herein are expressly incorporated herein by reference in their entirety.

What is claimed is:

1. A system for securing a wheeled pole to a frame of a mobile bed to form a movable assembly, the system comprising:

a linkage element including at least one mounting block effective to secure the linkage element to the frame, a first one of the at least one mounting blocks having a channel formed therein that is sized to receive at least a portion of the pole;

an attachment mechanism formed on the linkage element, the attachment mechanism including a first hook disposed to one side of the channel and a second hook disposed to an opposite side of the channel; and an elongate member having a first end elastically extendable from the linkage element for engagement with the first and second engagement members, such that the first and second hooks are effective to engage the elongate member and a portion of the elongate member is effective to capture the pole.

2. The system according to claim 1, wherein the channel is arcuate.

3. The system according to claim 1, wherein the channel has a groove formed therein for receiving a bead affixed to the pole such that axial rotation of the pole with respect to the linkage element is substantially prevented.

4. The system according to claim 1, wherein the linkage element is securable to an intermediate frame portion of the bed.

5. A system for securing a wheeled pole to a frame of a mobile bed to form a movable assembly, the system comprising:

a linkage element including at least one mounting block effective to secure the linkage element to the frame, a first one of the at least one mounting blocks having a channel formed therein that is sized to receive at least a portion of the pole;

an attachment mechanism formed on the linkage element, the attachment mechanism including a first engagement member disposed to one side of the channel and a second engagement member disposed to an opposite side of the channel;

an elongate flexible member having a first end extendable from the linkage element for engagement with the first and second engagement members, such that a portion of the flexible member is effective to capture the pole; and a non-elastomeric member secured to the flexible member at a predetermined location to form an enlargement, the non-elastomeric member having a first position effective to apply tension to the first end of the flexible member and a second position effective to remove tension from the first end of the flexible member.

6. The system according to claim 5, wherein the non-elastomeric member has a first end that is unable to pass through the linkage element and wherein the enlargement is able to pass through the linkage element.

7. The system according to claim 5, wherein the non-elastomeric member includes a ball member secured thereto.

8. The system according to claim 1, wherein the first end of the elongate member is unable to pass through the linkage element.

9. The system according to claim 1, further including third and fourth engagement members disposed on opposite sides of the channel.

10. The system according to claim 9, wherein the third and fourth engagement members each comprise hooks, and one of the third and fourth engagement members is misaligned with respect to at least one of the other engagement members.

11. The system according to claim 1, wherein the linkage element is movably secured to the wheeled pole for maintaining the pole in a generally upright position as the bed frame moves with respect to the wheeled pole in directions including up, down, inclined and declined.

12. A system for securing a mobile IV pole to a mobile hospital bed, comprising:

a linkage element matable with an intermediate frame portion of the bed, the linkage element having first and second mounting blocks effective to secure the linkage element to the bed, wherein the first mounting block has a bore and an aperture, the aperture having a first larger section and a second smaller section, and the second mounting block has a channel formed therein for receiving the IV pole;

an attachment mechanism secured to the linkage element, the attachment mechanism having a first engagement member disposed on one side of the channel and a second engagement member disposed on an opposite side of the channel;

an elastic cord slidably disposed within the bore, the elastic cord having a first end unable to pass through the bore and a second end securable to the frame of the bed, the first end of the elastic cord being extendable from the first mounting block for coupling with the first and second engagement members of the attachment mechanism such that the elastic cord captures the IV pole within the channel formed in the second mounting block; and an inelastic cord passing through the aperture having a first end securable to the elastic cord at a predetermined location and a second end unable to pass through the aperture, the inelastic cord further including a ball member having a geometry such that the ball member is able to pass through the larger section of the aperture and is unable to pass through the smaller section of the aperture.

13. A mobile hospital bed for coupling with a wheeled pole, comprising:

a frame;

a linkage element including at least one mounting block effective to secure the linkage element to the frame, a first one of the at least one mounting blocks having a channel formed therein that is sized to receive at least a portion of the pole;

an attachment mechanism formed on the linkage element, the attachment mechanism including a first hook disposed to one side of the channel and a second hook disposed to an opposite side of the channel; and an elongate member having a first end elastically extendable from the linkage element for engagement with the first and second engagement members, such that the first and second hooks are effective to engage the elongate member and a portion of the elongate member is effective to capture the pole.

14. A system for securing a wheeled pole to a frame of a mobile bed to form a movable assembly, the system comprising:

a linkage element including a first aperture and at least one mounting block effective to secure the linkage element to the frame, a first one of the at least one mounting blocks having a channel formed therein that is sized to receive at least a portion of the pole;

an attachment mechanism formed on the linkage element, the attachment mechanism including a first engagement member disposed to one side of the channel and a second engagement member disposed to an opposite side of the channel; and an elongate flexible member slidably capturable in the first aperture of the linkage element and having a first end extendable from the linkage element for engagement with the first and second engagement members, such that a portion of the flexible member is effective to capture the pole.

* * * * *